United States Patent [19]

Maier

[11] 3,933,279

[45] Jan. 20, 1976

[54] AEROSOL DISPENSER FOR FLUID PRODUCTS COMPRISING A PISTON PUMP ASSEMBLY FOR GENERATING COMPRESSED AIR

[75] Inventor: Christian Maier, Munich, Germany

[73] Assignee: Ciba-Geigy Corporation, Ardsley, N.Y.

[22] Filed: Nov. 16, 1973

[21] Appl. No.: 416,550

[30] Foreign Application Priority Data

Nov. 28, 1972 Sweden ..... 15486/72

[52] U.S. Cl. ..... 222/193; 239/349; 239/357

[51] Int. Cl.[2] ..... B67D 5/54

[58] Field of Search ..... 222/193, 373, 379, 383, 222/385, 401, 402; 239/350, 355, 357–363, 349

[56] References Cited

UNITED STATES PATENTS

| | | | |
|---|---|---|---|
| 2,918,221 | 12/1959 | Viard | 239/363 X |
| 3,343,797 | 9/1967 | Bach | 239/355 |
| 3,369,757 | 2/1968 | Boris | 239/361 X |
| 3,730,392 | 5/1973 | Marand | 222/193 X |
| 3,764,046 | 10/1973 | Riccio | 239/350 X |

FOREIGN PATENTS OR APPLICATIONS

| | | | |
|---|---|---|---|
| 1,034,016 | 4/1953 | France | 239/357 |

*Primary Examiner*—Robert B. Reeves
*Assistant Examiner*—Francis J. Bartuska
*Attorney, Agent, or Firm*—Wenderoth, Lind & Ponack

[57] ABSTRACT

An aerosol dispenser for fluid products is described which has a container for product to be dispensed, a separator piston pump for generating compressed air as a propellant, a spray nozzle for aspirating, and spraying product from the product container, flowpaths, for compressed air from the piston pump, and for product from the product container, to the spray nozzle, valves and associated with the flowpaths and opening the paths dependent on the piston approaching or reaching full compression stroke position in the cylinder of the aforesaid piston pump. An abutment in the piston pump acts, in the aforesaid compression stroke position, on the valve body of the compressed air flow-controlling valve. The product flow control valve has a flexible elastic diaphragm across the compressed air flowpath and separating the latter from the interior of the product container. A product outlet in the wall of the product container outside the flexible elastic diaphragm is part of the flowpath for product to the spray nozzle, and a movable valve member is mounted in the flexible elastic diaphragm, the flexible elastic diaphragm being biassed to hold the movable valve member to close sealingly the product outlet when the piston pump is in other than the full compression stroke position.

3 Claims, 9 Drawing Figures

AEROSOL DISPENSER FOR FLUID PRODUCTS COMPRISING A PISTON PUMP ASSEMBLY FOR GENERATING COMPRESSED AIR

BACKGROUND OF THE INVENTION

This invention relates to aerosol dispensers for fluid products, comprising a piston pump assembly for generating in the interior of the dispenser compressed air serving as propellant, and improved product flow control means. Various types of aerosol dispensers utilizing compressed air for dispensing fluids in the form of a spray are known. Among them are especially aerosol dispensers for liquid products described in U.S. Pat. No. 3,369,757 granted on Feb. 20, 1968 to M. Boris, which dispensers comprise a container for product to be dispensed, a piston pump separately from the product container, for generating compressed air as a propellant, a spray nozzle in which compressed air flowing therethrough aspirates, and sprays, product from the product container, flowpaths for compressed air and product to the spray nozzle from, respectively, the piston pump and the product container, and obturating means associated with the said flowpaths and opening these paths in dependence on a determined compression position of the piston in the cylinder of the aforesaid piston pump.

These known dispensers suffer from the drawback that the timely opening of the obturating means for the compressed-air flow which comprise a spring-biassed ball valve, is effected by the pressure of the compressed air alone, and hence not reliable as it depends on the quality and age of the spring material, and the valve must open before a valve shaft controlling the product flowpath can open. This leads unavoidably to a loss of compression.

In order to overcome this drawback, there is described in Belgian Pat. No. 768,039, granted on December 3, 1971 to the Applicant, an improved type of the above-described aerosol dispensers, wherein at least the valve controlling the flow of compressed air is opened by the mechanical action of rigid force-transmitting means comprising abutment means on the piston of the piston pump and on a displaceable valve disk or stem or the like valve body pertaining to the compressed air flow-controlling valve, which abutment means on the piston and valve body act one upon the other by direct contact or on lever means acting on the aforesaid valve body.

In a further development of this improved type of aerosol dispenser, the product container is replaceably mounted on top of a valve housing for the obturating means for the control of both flowpaths mentioned above, and which valve housing has a dependent sleeve forming the cylinder of the aforesaid piston pump, while the piston bears a mantle-type sleeve portion surrounding the cylinder-and-valve housing assembly as an outer guiding and protecting means.

However, with certain fluid products to be dispensed it may easily occur that deposits of aged or decomposed residual product are formed in the product flowpath leading through the valve housing to the spray nozzle, and especially in the later.

When this happens the entire dispenser has to be thrown away.

As the springs, which are usually made of steel, and the piston pump assembly constitute the more expensive part of such dispensers, U.S. Pat. No. 3,764.046 describes an aerosol-dispenser of the above-described type, wherein the product container and the spray nozzle insert are part of a replaceable unit, while the piston pump assembly including a compressed air flow-controlling valve means and springs is retained by the user, so that the above unit, which can be mass-produced and is hence inexpensive, is replaced each time a full product container is substituted for an empty container.

OBJECTS AND SUMMARY OF THE INVENTION

It is an object of the present invention to provide, in an aerosol dispenser of the last-described type, an improved product flow control means for controlling flow of product from the product container to the spray nozzle.

Another important object of the invention is to provide an aerosol dispenser of the last described type, the product flow control means are opened by direct mechanical contact with abutment means provided in the piston pump assembly.

Yet another object of the invention is to provide an aerosol-dispenser of the last-described type having improved air return means for the cylinder, after compression of air therein.

These objects are attained in accordance with the invention by an aerosol dispenser for fluid products comprising a container for product to be dispensed, a piston pump separate from the product container, for generating compressed air as a propellant, a spray nozzle in which compressed air flowing therethrough aspirates, and from which it sprays, product from the product container, flowpaths, for compressed air from the piston pump, and for product from the product container, to the spray nozzle, valve means comprising valve housings and displaceable valve bodies in the housings, and being associated with the said flowpaths and opening the paths dependent on the piston approaching or reaching full compression stroke position in the cylinder of the aforesaid piston pump, abutment means in the piston pump acting, in the aforesaid compression stroke position, by direct mechanical contact on at least the valve body of the compressed air flow-controlling valve means; and a mounting for the spray nozzle, which mounting has a passageway therein being part of the said compressed air-flowpath;

wherein the said product container and product flow control means are mounted on the mounting, and the mounting is detachably connected to the piston of the piston pump, forming an assembly with the piston; and wherein the piston is hollow and constitutes the housing for the remaining parts of the compressed air controlling valve means being mounted in the piston;

and which is improved by providing therein product flow control means which comprise flexible elastic wall means across the compressed air flowpath and separating the latter from the inerior of the product container;

product outlet means in the wall of the product container outside the said flexible elastic wall means and being part of the flowpath for product to the spray nozzle; and a movable valve member mounted in the flexible elastic wall means which latter wall means are biassed to hold the movable valve member to close sealingly the product outlet means when the piston pump is in other than the full compression stroke position. Ducts in the piston and the mounting provide the compressed air flowpath to the spray nozzle.

In a first embodiment of the dispenser according to the invention, the bias of the flexible elastic wall means is such as to yield to a pressure increase in the compressed-air flowpath which increase occurs when the abutment means contact and thereby move the valve body of the compressed air-flow controlling valve. The bias should preferably be such that the flexible wall yields to essentially the entire or at least a major portion of the compressed air escaping from the piston pump through the compressed-air flowpath.

In contrast to the slitted flexible product valve disc provided in the dispenser described in U.S. Pat. No. 3,764,046, supra, which is opened due to reduced pressure in the product flowpath to the spray nozzle, causing a suction on the flexible disc which opens the slit therein the re-closing of which when suction ceases is not always absolutely safe, the improved product valve means of the above-described first embodiment closes due to the biassed flexible wall mentioned above pulling a flat head portion which is provided on the movable valve body mounted in the flexible wall portion of the product container against a corresponding seat provided in the adjacent rigid wall of the product container surrounding the said flexible elastic wall portion, thereby hermetically sealing the product outlet communicating with the portion of the product flowpath provided in the mounting and leading to the spray nozzle in the latter, at all times when the pressure of the air present in the compressed air-flowpath is the same as that of the surrounding atmosphere. The product valve thus opens only when and while the air pressure in the compressed-air flowpath is above a certain limit value which is determined by the bias of the flexible elastic wall portion.

In another, preferred embodiment of the aerosol dispenser according to the invention, the movable valve member of the product flow control means is biassed toward closed position and comprises abutting means in an open end of the said passageway in the mounting and the valve body of the compressed air flow-controlling valve means bears contact rod means extending through the said passageway and engaging the abutting means of the product flow control means and thereby opening the product flowpath, when the said abutment means in the piston pump act on the valve body of the compressed air flow-controlling valve means.

Particularly preferred are also aerosol dispensers according to the invention, in which the product flow control means comprise elastic gasket means biassing the valve body of the control means toward closed position, the said valve body having a hollow portion and a duct for product therethrough and an annular beveled face engaged by the gasket means, and the valve housing of the product flow control means comprises an elastically expandable membrane against one face of which the said hollow valve housing portion abuts when the valve body is in closed position, and the opposite face of which is engaged by the contact rod means mentioned hereinbefore, when the abutment means in the piston pump act on the valve body of the compressed air flow-controlling valve means. In another embodiment, the product flow control means can comprise valve seat means engaged by the valve body of the said product flow control means when in the closed position, and elastically deformable membrane means engaging the abutting means of the last-mentioned valve body and biassing the latter into engagement with the valve seat means.

Structural and operational features of preferred embodiments of dispensers according to the invention are shown in detail in the accompanying drawings and will be readily understood therefrom taken alone or together with the description thereof following hereinafter.

BRIEF DESCRIPTION OF THE DRAWINGS

FIG. 6 is a sectional view of the same embodiment as shown in FIG. 5, taken along the line VI—VI therein; FIGS. 8 and 9 show, in partial sectional views, further embodiments of the product flow control means in a dispenser as shown in FIGS. 5 to 7.

DETAILED DESCRIPTION OF THE EMBODIMENTS

Figure 1:
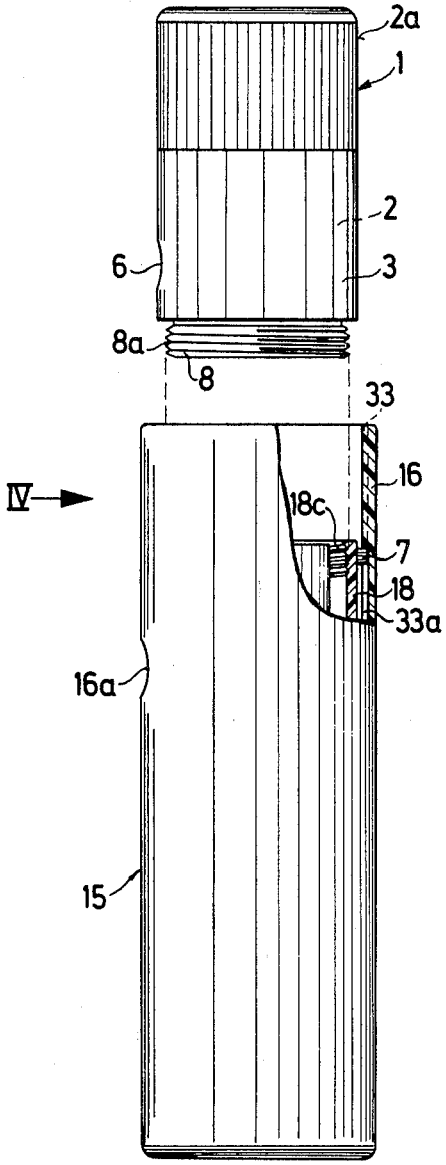
FIG. 1 represents an exploded front view, partly sectioned, of the two basic parts making up the structure of the dispenser according to the invention.
Figure 2:
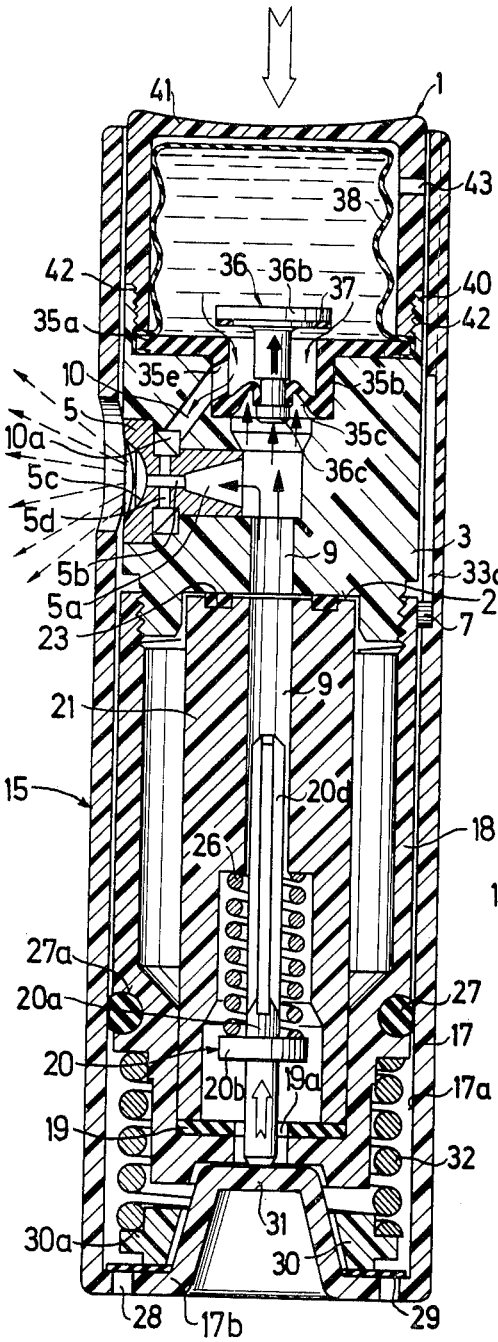
FIGS. 2 and 3 are sectional views of another embodiment of the dispenser, FIG. 2 showing the parts in the dispensing position, and FIG. 3 an intermediate position of the parts after dispensing and before the parts have fully reached the non-dispensing or rest position.
Figure 3:
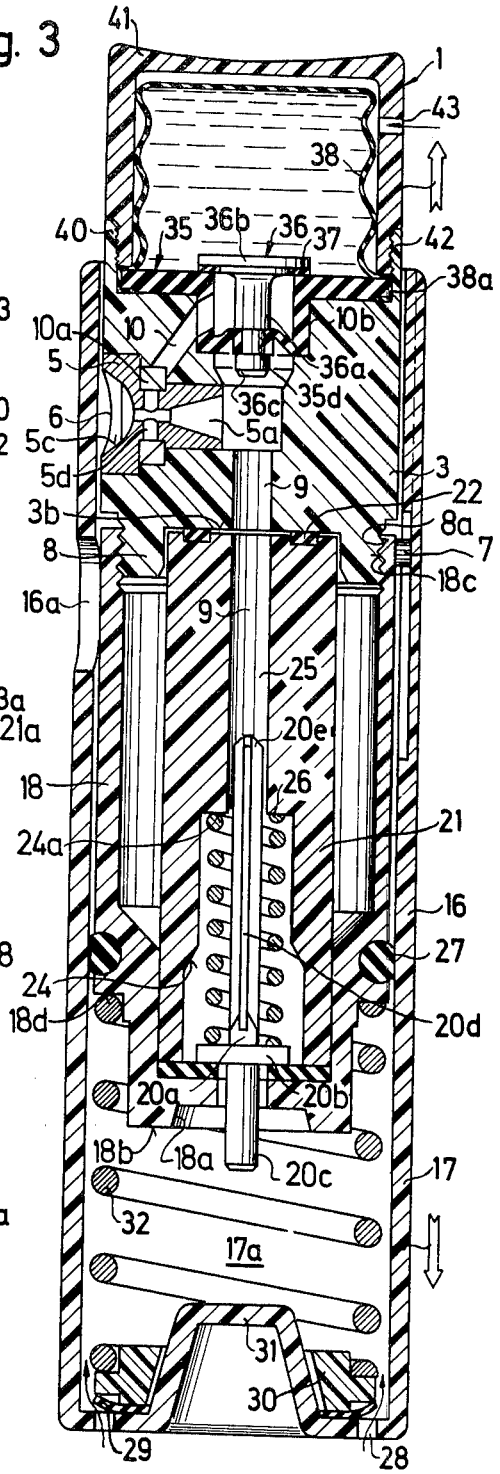

As shown in FIGS. 1, 2 and 3, the dispenser consists of two units which are detachably connected with each other. The upper unit 1 comprises the product container 2 having a knurled outside surface 2*a*, which can be integral with a mounting 3, in a recess of which there is located a spray nozzle insert 5 the discharge orifice 6 of which opens in the lateral wall of mounting 3. The latter bears on its end face 3*b* away from the product container 2 an annular projection or dependent sleeve 8 which is provided on its annular outer surface with a threads 8*a*.

The spray nozzle insert 5 preferably contains a Venturi nozzle as shown in FIGS. 2 and 3, having a chamber 5*a* of convergent cross section, a narrowest passage or neck duct 5*b* and a chamber 5*c* of divergent cross section opening through discharge orifice 6 to the outside. An axial duct 9 leads from the bottom face 3*b* through mounting 3 to the convergent chamber 5*a*. A passageway 10 connects the hollow interior of product container 2 via an annular recess 10*a* and a plurality of radical passages 5*d* with neck duct 5*b* of the Venturi nozzle 5.

The lower dispenser unit 15 comprises an outer mantle or cylinder 16 the lower bottom end portion 17 of which constitutes the cylinder of a piston pump assembly for the generation of compressed air when using the dispenser. The mantle 16 has an opening 16*a* which, in the dispensing position, registers with discharge orifice 6 of spray nozzle insert 5, while it covers that orifice in the non-dispensing position.

The hollow piston 18 of the piston pump assembly constitutes a valve housing being part of the compressed air flow-controlling valve means, and houses an obturating gasket 19 having a central orifice 19*a* through which a poppet valve body 20, having a stem part 20*a* and a disk-shaped flange 20*b*, extends with its lower stem portion 20*c* forming a poppet valve-actuating pin into, and in the rest position out of, a recess 18*a* in the front end wall 18*b* of piston 18. Obturating gasket 19 is held in place in the bottom of the hollow interior of piston 18 by means of a cylindrical retaining member 21. Piston 18 bears on the inside wall of its outer rear end away from the front end 18*b* inner threads 18*c* by means of which it is screwed on to the threads 8*a* of mounting 3. Thereby, retaining member 21 is held in place by being squeezed between the gasket 19 and a sealing ring 22 inserted in an annular groove 23 in the outer end face 21*a* of member 21.

From an inner recess 24 of retaining member 21, about valve body 20, an axial duct 25 of reduced cross sectional area leads to the rear end face 21*a* of member 21 and opens in the latter to register with duct 9 in mounting 3, thus being part of a flowpath for compressed air leading from the interior of cylinder 17 via piston recess 18*a* and orifice 19*a* in gasket 19 through recess 24 and ducts 25 and 9 to convergent chamber 5*a* of spray nozzle 5.

In the recess 24 of retaining member 21, there is housed a return spring 26 one end of which is supported on the disk-shaped flange 20*b* of poppet valve body 20, and the other on the end wall 24*a* of recess 24, thus urging the valve body 20 into a closed position against gasket 19.

Figure 4:
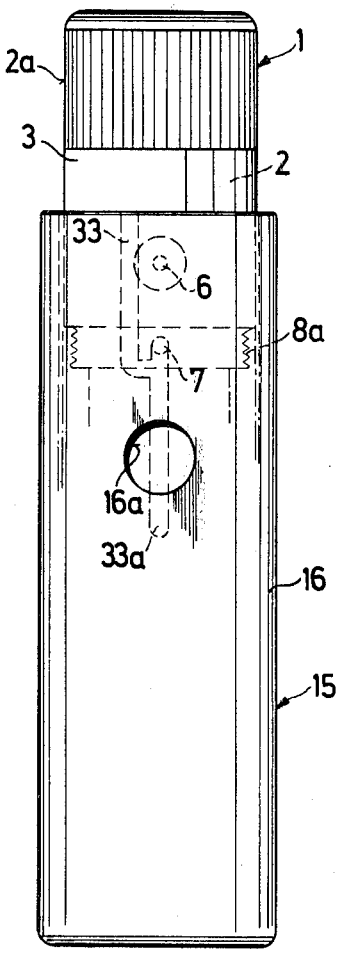
FIG. 4 represents a front view of the lower part of the dispenser shown in FIGS. 2 and 3, but turned about an angle of 90°.

The interior 17*a* of cylinder 17 is sealed off against the surrounding atmosphere by means of a sealing ring 27 held in a circumferential groove 27*a* about piston 18 and sealingly and slidingly engaging the inner wall of cylinder 17. Moreover, vent holes 28 in the bottom end wall 17*b* of cylinder 17 are closed off, during compression, by means of the flexible elastic portion of a flap valve 29 which is held in position across the vent holes 28 on the inside of cylinder bottom wall 17*b* by means of a retaining ring 30 held in place about an inwardly projecting frustoconical centering and abutting member 31 by means of return spring 32 which is located in the cylinder interior 17*a* and has its one end supported on an annular shoulder 30*a* of retaining ring 30 and its other end against an annular shoulder 18*d* about piston 18 a short distance away from piston front wall 18*b*. A guiding peg 7 projects from the outer wall of piston-valve housing 18 near the end thereof joined to mounting 3 and engages a longitudinal groove 33*a* in the inside wall of mantle 16 into which it is inserted through a bayonet slot 33 (FIG. 4).

In the embodiment of FIGS. 2 and 3, product is held in a flexible collapsible or compressible bag which is in turn housed in a product container.

In a recess 10*b* of mounting 3 there is inserted a valve gasket 35 having a flat annular gasket portion 35*a*, and a cup portion 35*b* the vaulted bottom wall 35*c* of which is very flexible and elastic and has a central opening 35*d* in which there is sealingly inserted and firmly held the stem portion 36*a* of a poppet valve member 36, the disk-shaped head portion 36*b* of which rests with its periphery on the flat gasket portion 35*a*, preferably by means of a sealing ring 37 fixed on the underside of head portion 36*b*, whereby the interior of a product bag 38, the peripheral rim zone 38*a* of which about its opening is crimped about the outside rim portion of flat gasket portion 35*a* is sealed off. Gasket 35 is held about the latter and in position in the recess of projecting socket portion 40 of mounting 3 by means of a cap member 41 which is screwed into place in socket portion 40 by means of a threading 42. Cap member 41 has at least one vent hole 43 therein by way of which the interior of the cap member is always in free communication with the outside air, so that ambient pressure is exercised at all times on the outside of product bag 38. In the wall of cup portion 35*b* there is a lateral opening 35*e* through which product can flow from bag 38 to the spray nozzle 5.

Poppet valve stem 20*a* is provided with an extension rod 20*d* which extends at all times for better guidance into the lowermost end of axial duct 25 retaining member 21. The extension rod 20*d* is provided with a plurality of longitudinal grooves 20*e* to provide less restricted passage of compressed air therealong.

In operation, the upper unit 1 is pressed into the outer mantle 16, for instance by the user holding the mantle 19 below the nozzle discharge orifice 6 with the thumb and middle finger and exerting pressure on the top product container lid 41 with the index finger. Thereby piston 18 compresses air in the interior 17*a* of cylinder 17.

A pressure builds up in cylinder interior 17*a*, flap valve 29 is urged against the inner bottom wall 17*b* of cylinder 17, thus obturating vent holes 28.

Toward the end of the compression stroke, poppet valve actuating pin 20*c* is contacted and raised by abutting member 31, poppet valve disk-flange 20*b* is lifted from gasket 19 with compression of return spring 26, and compressed air flows through ducts 25 and 9 and through nozzle 5. The compressed air flowing through axial duct 9 of mounting 3 impinges on the flat tip 36*c* of poppet valve stem portion 36*a* and raises the poppet valve body 36 from its seat gasket portion 35*a*, (see FIG. 2), before entering the convergent chamber 5*a* of nozzle 5, thereby uncovering lateral opening 35*e* and permitting product to be suctioned via opening 35*e* and product passageway 10 into annular chamber 10*a* and into the compressed air stream flowing through Venturi neck 5*c*.

As soon as compressed air is exhausted and pressure on upper unit 1 ceases, valve 11 closes again, product flow ceases, but air from the outside may pass through the slot 11*a* at the moment of closing from the nozzle 5, and replace product withdrawn from container 2. Return spring 26 causes poppet valve body 20 to close again, and return spring 32 urges cylinder 17 away from piston 18. As this causes a partial vacuum in cylinder interior 17*a*, flap valve 29 is bent upwardly and outside air fills the cylinder interior 17*a*. The dispenser is then ready for renewed use.

Figure 5:
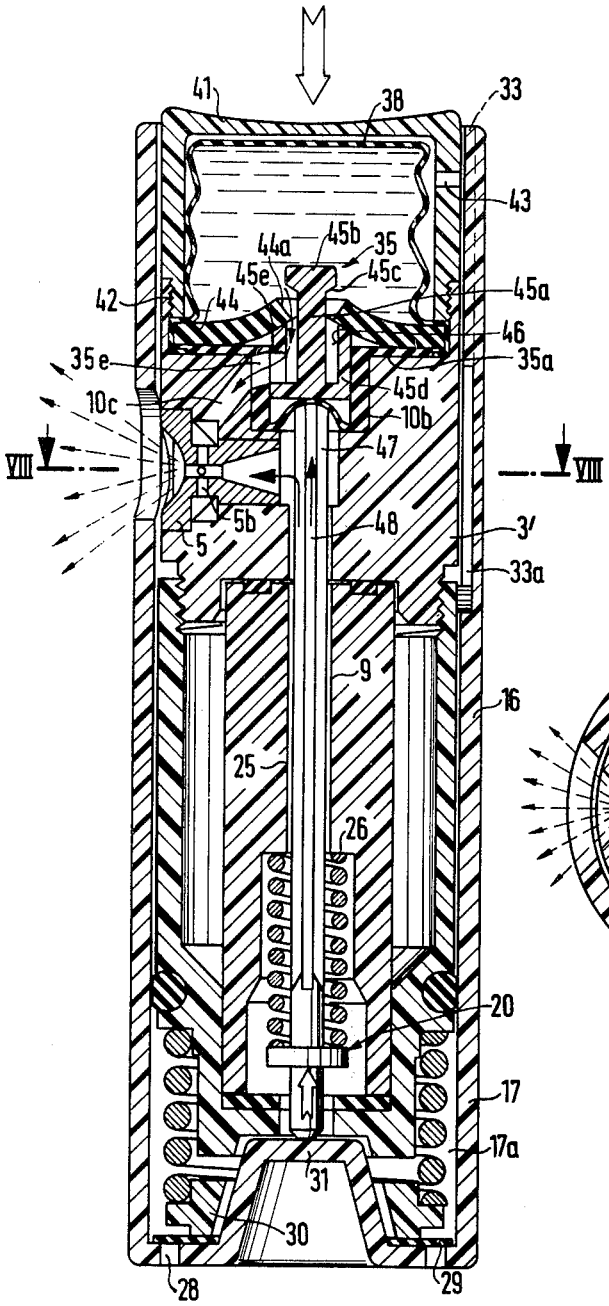
FIGS. 5, 6 and 7 show yet another embodiment of the dispenser, including a preferred type of product flow control means, FIG. 5 showing the parts in the dispensing position.
Figure 6:
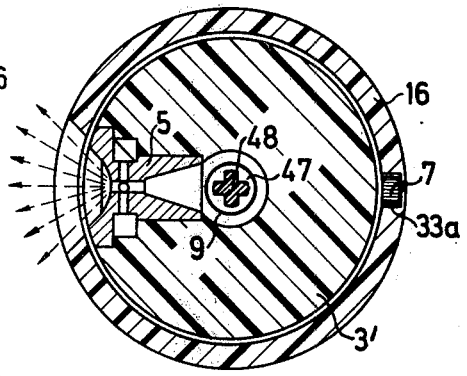
Figure 7:
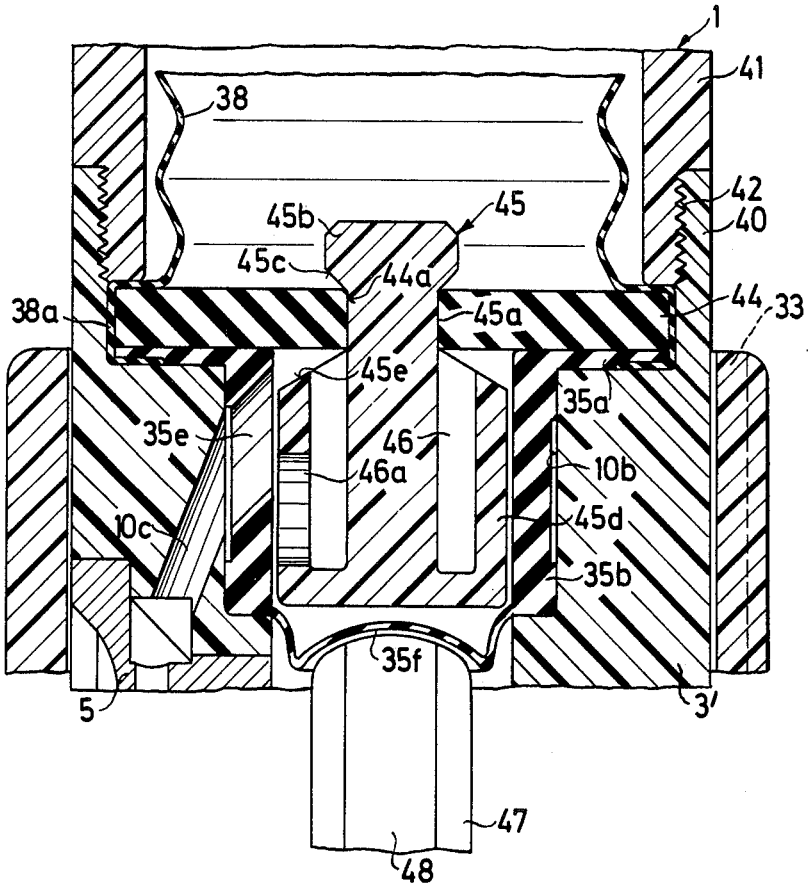

In a preferred embodiment of the invention which is shown in FIGS. 5, 6 and 7, the opening and closing of both the valve means for controlling the compressed air flow and for controlling product flow is effected by direct mechanical action, independently of the degree of vacuum generated at the product flow control means.

For this purpose, the latter means comprise a self-closing valve consisting of a valve gasket 35 similar to that used in the embodiment of FIGS. 2 and 3, but having its flexible and elastic bottom wall 35*b* unperforated. On the flat annular gasket portion there rests an annular flexible elastic gasket 44, which can also be made integral with valve gasket 35. The width of central gasket opening 44*a* is smaller than that of cup portion 35*b*, and preferably slightly smaller than the diameter of the narrowest neck portion 45*a* of a valve stem 45 which has a head portion 45*b* of greater diameter than neck portion 45*a* and merging with the latter via an upper beveled annular zone 45*c*, which head portion protrudes into the interior of product bag 38, while the neck portion 45*a* merges at its other end with a hollow valve stem plug 45*d* of greater diameter via a lower beveled annular zone 45*e*. The annular interior chamber 46 of stem plug 45*d* is connected through opening 46*a* in plug wall and opening 35*e* in a cup portion 35*b* of valve gasket 35 with product duct 10*c* and via the latter with spray nozzle 5, and, on the other hand, via a plurality of ducts 46*b* opening in lower beveled zone 45*e* of stem 45 with the interior of bag 38, when the central portion of gasket 44 about its central opening 44*a* is bent inwardly into bag 38 and out of contact with stem neck portion 45*a*, thus clearing the openings of ducts 46*b*.

This occurs when the extension rod 47 bearing longitudinal grooves 48, which rod is long enough to extend through the entire length of duct 25 and into duct 9 of mounting 3', contacts the outside of bottom membrane 35*f* which closes off cup portion 35*c* of valve gasket 35, and raises the latter membrane and together with valve stem 45 due to the fact that poppet valve body 20 is lifted by coming into contact with abutting member 31.

This means that the poppet valve body 20 and valve stem 45 will open the flowpaths for compressed air and for product practically simultaneously, unless the opening of the product flowpath is delayed a very short time, for instance by locating the orifices of axial ducts 46*b* at a smaller or greater distance from where the lower beveled zone 45*e* and the neck portion 45*a* merge.

This will have the advantage that product flow is cut off when terminating spraying, before the flow of compressed air ceases completely, thereby preventing or reducing the accumulation of residual product in the product flowpath to nozzle 5. Such accumulated product will often be decomposed and form tacky or resinous residues which will clog the product flowpath and possibly the spray nozzle neck duct 5*b*.

Figure 8:
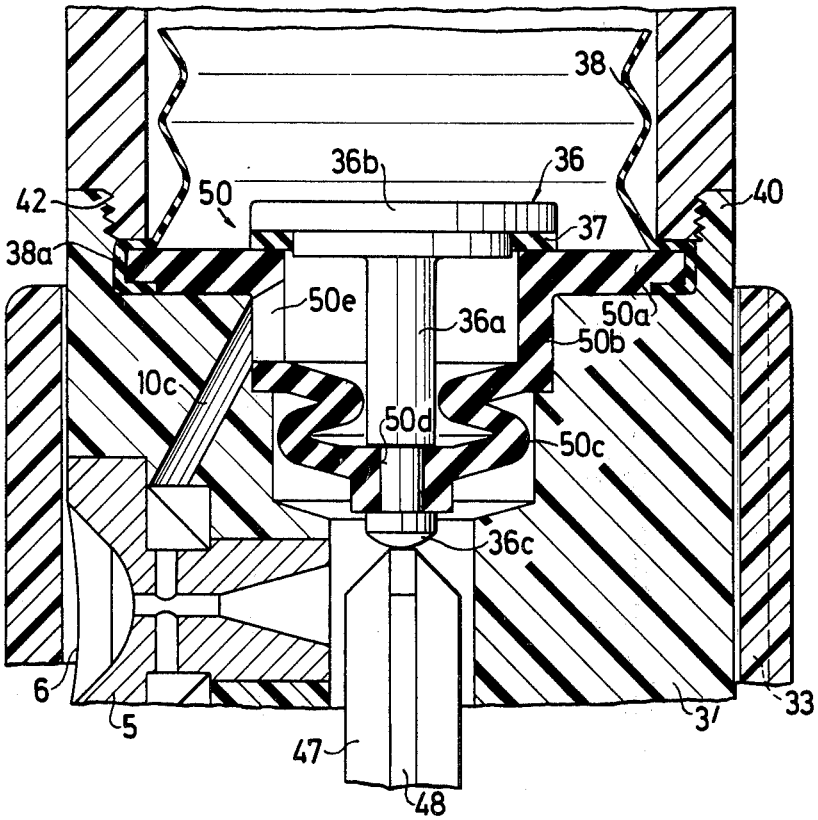
FIG. 8 shows the same embodiment as FIGS. 5 and 6, but with the parts in the non-operative or rest position.
Figure 9:
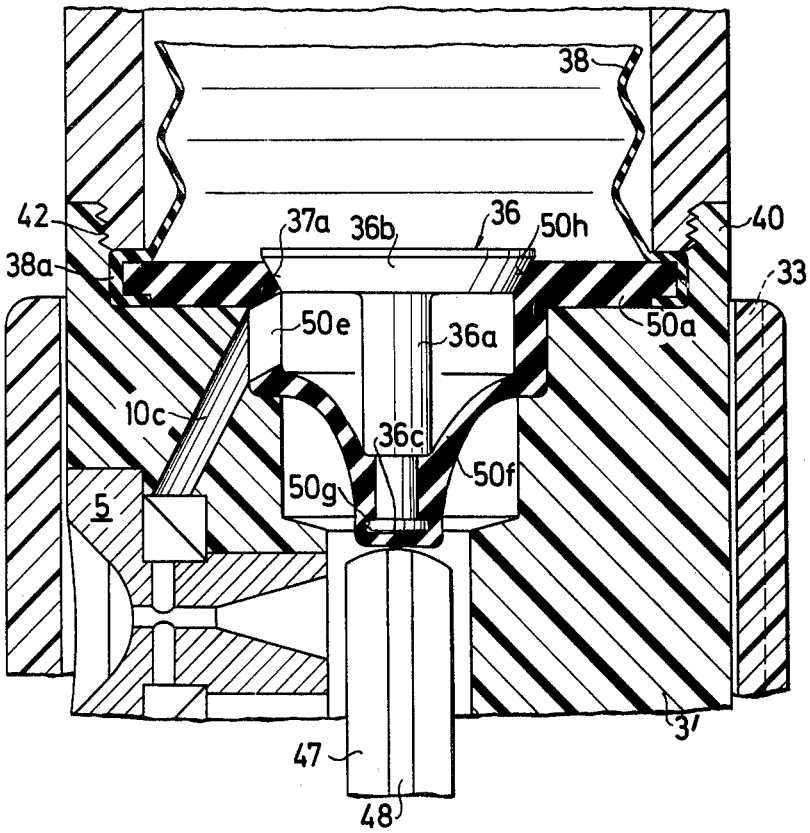

FIGS. 8 and 9 show further embodiments of the product flow control means, combining features of the embodiments thereof shown in FIGS. 2 and 3 on the one hand, and 5 to 7 on the other hand. Thus, the embodiment of FIG. 8 shows a self-closing valve 50 equipped with the same kind of poppet valve body 36 as the product flow control valve in the embodiment of FIGS. 2 and 3. However, the vaulted bottom wall 50*c* of the cup portion 50*b* of valve 50 is of accordion shaped and, after pressure on the flat tip 36*c* of poppet valve member 36 has ceased, which pressure may be mechanically exerted by the top end of extension rod 47, or dynamically by compressed air impinging on tip 36*c* and the underside of accordion wall 50*c*, the latter will return to its initial uncompressed condition as shown in FIG. 8 and will pull the disk-shaped head portion 36*b* with its annular peripheral sealing ring 37 into sealing contact with the valve seat formed by the flat annular gasket portion 50*a* of valve 50.

Accordion wall 50*c* has a central opening 50*d* for receiving the valve stem portion 36*a* therein, and cup portion 50*b* has a lateral opening 50*e* for the flow of from the product bag 38 when valve 50 is open.

FIG. 9 shows a dispenser similar to that of the preceding embodiment of FIG. 8, but with a somewhat different product flow control valve structure. In most cases, this structure will be preferred because of its simple, rugged nature.

The accordion wall 50*c* of product control valve 50 in the preceding embodiment is replaced by a flexible, compressible, but less elastic bottle neck-shaped membrane 50*f* which is unperforated and encloses the valve stem tip 36*c*, the latter being pressed into a recess 50*g* in the inside wall of membrane 50*f*.

A further simplification resides in the replacement of annular sealing ring 37 by a frustoconically beveled lower rim 37*a* or disk shaped head portion 36*b* of poppet valve member 36. In the closed position, this beveled rim 37*a* is sealingly seated on a correspondingly beveled annular zone 50*h* about the central opening of flat annular gasket portion 50*a* of self-closing valve 50. The operation of this embodiment is the same as that of the embodiments shown in FIGS. 5 to 8.

With this arrangement, the upper dispenser unit 1 including the product container 2 and the spray nozzle insert 5 are replaceable. All that is necessary is to grasp the knurled exterior surface 2*a* and unscrew the mounting 3 from the open end of the hollow piston 18. Since this threaded engagement is the only interfitting engagement between the mounting 3 and the remainder of the device, once the threaded engagement is ended, the upper dispenser unit 1 can simply be withdrawn from the remainder of the device. Replacement requires only threading a new upper dispenser unit 1 into place. The advantage of this arrangement is that not only is the supply of the product in the container 2 replaced, but a whole new product dispensing system is provided, i.e. the product flow control means 11, 35 or 50, the passageway 10 or 10*c* and the spray nozzle insert 5. This avoids malfunctions of the device due to clogged or improperly operating product flow control means and passages, and clogged nozzle inserts.

The product flow control means 35 or 50 are a novel feature of the present invention. They comprise a membrane of flexible, elastic material, such as rubber or synthetic resin which is unaffected by the product being dispensed.

The air return means in the cylinder bottom is also simple and yet reliable in operation, and consists only of the gasket 29 and the retaining ring 30 and the configuration of the inside of the closed end of the cylinder.

Thus, the product container and the spray nozzle insert are part of a replaceable unit, while the piston pump assembly including a compressed air flow-controlling valve means and springs is retained by the user, so that the above unit, which can be mass-produced and is hence inexpensive, can be replaced each time a full product container is substituted for an empty container.

It will also be seen that this aerosol dispenser by its very nature dispenses a metered dose of product and the dose can be varied by changing the size of the piston pump.

In preferred embodiments of the aerosol dispenser according to the invention, not only the compressed air flow-controlling valve means but also the product flow control means are opened by direct mechanical contact with abutment means provided in the piston pump assembly, when the upper dispenser unit is depressed into the cylinder of the piston pump, and the piston approaches or reaches the full compression stroke position. Especially advantageous features of these preferred dispensers are that product can be aspirated only after compressed air has begun flowing through the spray nozzle, and that the dispensers can be used equally well in upright as in upside-down or in oblique position without having excessive amount of product flow into the spray nozzle under the effect of gravity; thereby the same fineness of spray is preserved regardless of the position of the dispenser, and is determined exclusively by the characteristics of the spray nozzle and of the product being sprayed.

I claim:

1. In an aerosol dispenser for fluid products comprising a container for product to be dispensed, a piston-cylinder pump means separate from the product container, and having piston and cylinder means, one of which is movable relative to the other which is fixed, for generating compressed air as a propellant, spray nozzle in which compressed air flowing therethrough aspirates, and sprays product from the product container, flowpaths, for compressed air from the pump means, and for product from the product container, to the spray nozzle, valve means comprising valve housing and displaceable valve bodies in the housing, and being associated with said flowpaths and opening the paths dependent on the movable means of said pump means approaching or reaching full compression stroke position in the fixed means of the aforesaid pump means, abutment means in the pump means acting, in the aforesaid compression stroke position, by direct mechanical contact on at least the valve body of the compressed air flow-controlling valve means; and a mounting for said spray nozzle and having a passageway therein which is part of said compressed-air flowpath; said product container and product flow control valve means being mounted on said mounting and said mounting being detachably connected to the fixed means of said piston and cylinder means, forming a mounting-piston assembly; and said fixed means being hollow and constituting the housing for the remaining parts of said compressed air controlling valve means; the improvement comprising a. flexible elastic wall means across said compressed air flowpath and separating the latter from the interior of said product container;

b. product outlet means in the wall of said product container outside said flexible elastic wall means and being part of said flowpath for product to said spray nozzle; and c. a movable valve member mounted on said flexible elastic wall means and biased toward the closed position and having abutting means in an open end of said passageway in said mounting, and said valve body of said compressed air flow-controlling valve means having contact rod means extending through said passageway and engaging said abutting means of said product flow control valve means and thereby opening the product flowpath, when said abutment means in the piston pump acts on the valve body of said compressed air flow-controlling valve means.

2. An aerosol dispenser as claimed in claim 1, wherein said product flow control valve means comprise elastic gasket means biassing said valve body of said control valve means toward the closed position, said valve body has a hollow portion having a duct for product therethrough and an annular beveled face engaged by said gasket means, and the valve housing of said control valve means comprises an elastically expandably membrane against one face of which said hollow valve housing portion abuts when the valve body is in the closed position and the opposite face of which is engaged by said contact rod means when said abutment means in the pump means acts on the valve body of said compressed air flow-controlling valve means.

3. An aerosol dispenser as claimed in claim 2, wherein said product flow control valve means comprise valve seat means engaged by the valve body of said control means when in the closed position and elastically deformable membrane means engaging said abutting means of said last-mentioned valve body and biassing the latter into engagement with said valve seat means.

* * * * *